United States Patent [19]

Boltrek

[11] 4,239,102

[45] Dec. 16, 1980

[54] HANDRAIL APPARATUS

[75] Inventor: Henry Boltrek, Freeport, N.Y.

[73] Assignee: Westinghouse Electric Corp., Pittsburgh, Pa.

[21] Appl. No.: 12,545

[22] Filed: Feb. 15, 1979

[51] Int. Cl.[3] ..... B66B 9/14

[52] U.S. Cl. ..... 198/336; 198/814

[58] Field of Search ..... 198/336, 814, 335; 74/242.8, 242.9

[56] References Cited

U.S. PATENT DOCUMENTS

| | | | |
|---|---|---|---|
| 2,794,538 | 6/1957 | Schenk | 198/814 |
| 3,712,447 | 1/1973 | Boltrek et al. | 198/336 |

*Primary Examiner*—Joseph E. Valenza

*Attorney, Agent, or Firm*—D. R. Lackey

[57] ABSTRACT

Self-adjusting handrail apparatus, including a handrail member which is both pushed and pulled about the substantially continuous guide loop. The guide loop includes a gap linked by a biasing arrangement which maintains a slight tension in the handrail member, notwithstanding changes in the loop length of the handrail member.

6 Claims, 6 Drawing Figures

HANDRAIL APPARATUS

BACKGROUND OF THE INVENTION

1. Field of the Invention

The invention relates in general to handrail apparatus, and more specifically to handrail apparatus which includes a continuous, flexible handrail member which is driven about a guide loop.

2. Description of the Prior Art

U.S. Pat. No. 3,712,447, which is assigned to the same assignee as the present application, discloses a handrail guide system for passenger conveyors, such as escalators and movable walks, which permits the handrail to be both pushed and pulled about a substantially continuous guide loop. This arrangement has many advantages over those arrangements which obtain the tractive force necessary to propel the handrail member by only pulling it around a discontinuous guide loop. The latter arrangement develops a relatively large tension in the handrail member, causing it to wear and stretch. In the hereinbefore mentioned U.S. Patent, the length of the guide loop is initially adjusted to the exact length of the handrail loop.

Despite the fact that large tensions are not produced in the handrail member by the arrangement disclosed in the hereinbefore mentioned patent, the loop length of the handrail changes after initial installation, due to such things as manufacturing variations, inherent changes in the lengths of the materials used in the handrail as the handrail flexes and wears, humidity, temperature, etc. Thus, the guide loop length must be periodically readjusted. Periodic readjustment accommodates permanent changes in the loop length of the handrail, but it does not correct temporary changes such as those due to humidity and temperature.

SUMMARY OF THE INVENTION

Briefly, the present invention is a new and improved handrail arrangement of the push-pull type disclosed in the hereinbefore disclosed U.S. patent, which includes a guide loop which automatically adjusts its length in response to changes in the loop length of the handrail member. Thus, temporary length changes in the handrail, as well as permanent changes, over a predetermined adjustment range, are automatically accommodated. Readjustment is only required when the length change of the handrail member exceeds a predetermined range of automatic adjustment.

A flexible portion of the guide loop is cut, and the cut ends are linked by a biasing arrangement which biases the cut ends away from one another. The guide loop length is initially adjusted via a manually adjustable take-up, such that a predetermined gap is produced between the cut ends of the flexible portion of the guide loop, enabling the loop length of the handrail to increase, or decrease, over a predetermined adjustment range. The biasing means creates a very slight tension in the handrail over the entire adjustment range, which is ideal for the push-pull guide arrangement of the hereinbefore mentioned U.S. patent. The maintenance frequency is thus substantially reduced, and handrail wear is accordingly reduced.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF THE PREFERRED EMBODIMENTS

The present invention is an improvement relative to the handrail drive arrangement described and claimed in the hereinbefore U.S. Pat. No. 3,712,447. Accordingly, U.S. Pat. No. 3,712,447 is incorporated into the present application by reference. This patent may be referred to for a complete description of transportation apparatus which may utilize the teachings of the invention.

Figure 1:
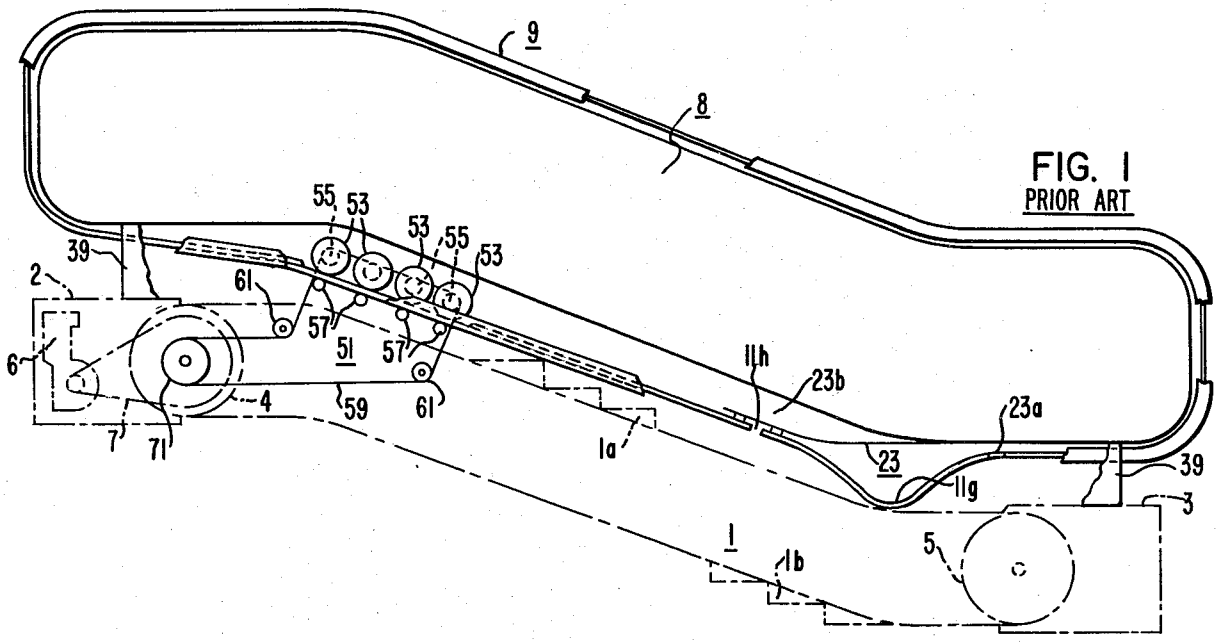
FIG. 1 PRIOR ART
FIG. 1 is an elevational view of transportation apparatus having a handrail guide arrangement constructed according to the teachings of the prior art.

Referring now to the drawings, FIG. 1 is substantially the same as FIG. 1 of the incorporated patent, illustrating an elevational view of prior art transportation apparatus which may utilize the teachings of the invention. The transportation apparatus shown in FIG. 1 includes a conveyor 1 for transporting passengers between a first landing 2 and a second landing 3. Conveyor 1 may be of the endless type employed in the escalator illustrated, or in a moving walk. Conveyor 1 has an upper load bearing run **1*a* on which passengers stand while being transported between the landings, and a lower return run 1*b***.

The conveyor 1 moves in a closed path which extends around sprocket wheels 4 and 5 in a conventional manner. The upper sprocket wheel 4 may be rotated by an electric motor 6 through a suitable drive mechanism including a chain 7. Alternatively, conveyor may be of the modular type disclosed in U.S. Pat. No. 3,707,220, which patent is assigned to the same assignee as the present application.

A balustrade 8 is disposed above the conveyor 1, with the balustrade 8 supporting a handrail 9. The handrail 9 is usually disposed on each side of the conveyor. The handrail 9, which is C-shaped in cross-section, is in the form of a continuous, closed loop, and it is mounted with the opening of the "C" disposed towards the center of the loop, whereby the base of the handrail is available to be grasped by passengers on the transportation apparatus.

Handrail 9 is guided in its closed loop by a substantially continuous guide member 11. The guide member 11 has an upper portion which extends along the upper surface of the balustrade, a lower section, two end sections, and a flexible section **11*g*. Portions of the handrail 9 have been cut away in FIG. 1, in order to expose various portions of the guide member 11. The guide member 11 forms a continuous guide for the handrail 9, except for a section where the handrail passes through a drive mechanism 51, and except for a small gap 11***h* which is part of a take-up 23*b*.

Guide member 11 may be of the conventional T-shape, or Y-shape. Alternatively, the guide member 11 may be U-shaped with vertical legs ending in horizontal flanges. Guide member 11 is secured to the balustrade 8 at various points along its length.

The handrail 9 fits over the flanges of the guide member 11 to restrain the handrail and guide it in the path formed by the guide member 11.

The overall length of the guide loop is adjustable to the exact length of the handrail 9, by constructing a portion of the guide of a flexible member, indicated at 11*g*. The flexible portion 11*g* is formed of a flexible yet stiff material. One end of the flexible guide member 11*g* is connected to the rigid guide portion at 23*a*. The other end of the flexible portion 11*g* of the guide member 11 is aligned with an end of the rigid guide member, but spaced therefrom to provide a take-up 23*b*. The flexible portion 11*g* should be made of a material which will flex easily but will maintain its bowed shape against the moderate forces exerted by the handrail which tend to collapse the bowed portion. Polyvinyl has been found to be suitable for this purpose, but a light gauge metal guide, such as extruded aluminum, may also be used. A gap 11*h* at the take-up 23*b* provides the length adjustment of the guide loop. This gap in the guide loop is not large enough to interfere with the operation of the guide rail system, since the handrail 9 has a certain amount of stiffness, which enables it to be pushed and pulled across small gaps in the guide loop.

With a substantially continuous guide loop which is adjusted to the length of the handrail 9 so that a large static tension is required to maintain the handrail in the guide loop, the handrail can be pushed as well as pulled about the closed loop through the utilization of much lower forces at any particular point on the handrail than is required in systems which merely pull the handrail about the guide loop.

Handrail 9 may be driven by any suitable driving means capable of applying both a pushing and pulling force, and which does not require that the entire handrail be under a high tension. The drives disclosed in U.S. Pat. Nos. 3,414,109 and 3,779,360 are suitable for this purpose. For example, the driving force may be applied to the handrail by a series of drive wheels 53. A sprocket wheel 55 imparts a rotational motion to the wheels 53 in response to movement of a chain 59. Chain 59 passes over the sprocket wheel of each of the drive assemblies. Chain 59 also passes over the sprocket wheel 71 which is connected to the sprocket wheel 4 on the conveyor, so that the drive assemblies are rotated by motor 6. The gearing is such that the handrail is driven in synchronism with the conveyor 1. Idler sprockets 61 serve as guides for the chain 59. A pressure roller 57 is rotatably mounted below each drive wheel, to hold the inside of the base portion of the handrail in tractional engagement with the drive wheels 53.

Although the flexible portion 11*g* of the guide means is shown fixed at one end and adjustable at the take-up 23*b* at the other end, it is to be understood that the flexible portion of the guide means could be adjustably fastened with take-ups at both ends thereof.

As hereinbefore stated, the loop length of the handrail 9 may change during use, permanently and/or temporarily. The guide member 11, however, is adjusted to the length of the handrail 9 at the time of initial installation. As a mismatch between the loop lengths occurs, handrail wear is increased, and thus the take-up 23*b* is periodically readjusted such that the guide loop length is reset to the latest handrail length.

The present invention maintains optimum loop length of the guide loop defined by guide member 11, by automatically and continuously adjusting the length of the guide loop to the length of the handrail loop. Thus, handrail wear is substantially reduced, and the take-up 23*b* need be adjusted only when the length of the handrail loop exceeds the automatic adjustment range.

Figure 2:
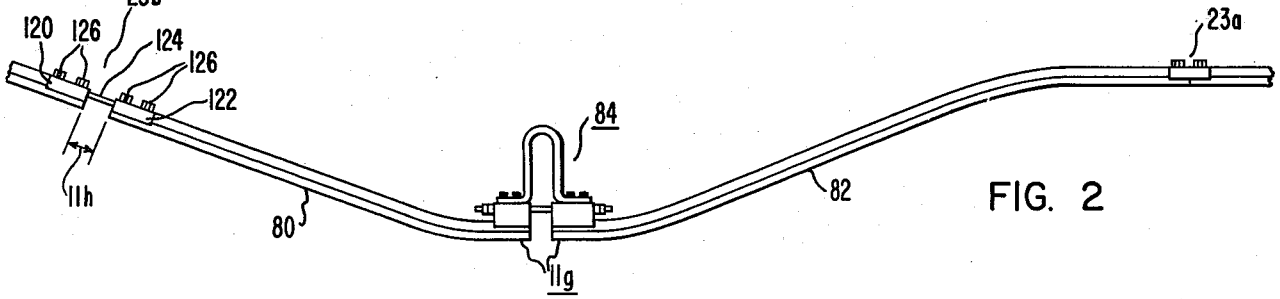
FIG. 2 is a fragmentary view of handrail guide apparatus illustrating how the transportation apparatus of FIG. 1 may be modified according to the teachings of the invention.
Figure 3:
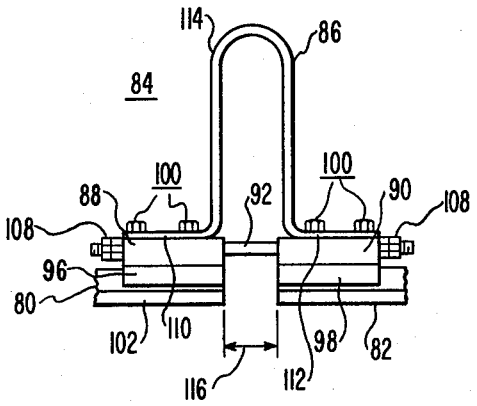
FIG. 3 is an enlarged view of a portion of the apparatus shown in FIG. 2, illustrating a biasing arrangement in the guide loop, with the arrangement being illustrated prior the installation of the handrail member.
Figure 4:
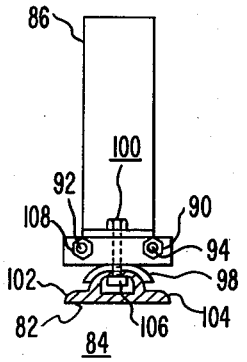
FIG. 4 is an end view of the biasing arrangement shown in FIG. 3.

More specifically, FIG. 2 illustrates a first embodiment of the invention. The flexible portion 11*g* of the handrail guide member 11 is severed or cut into first and second separate members 80 and 82, respectively, and the two cut ends are aligned and linked by biasing means 84. FIG. 3 is an enlarged elevational view of the biasing means 84 shown in FIG. 2, and FIG. 4 is an end view of the biasing means 84 shown in FIG. 3.

Biasing means 84 includes a long stroke leaf spring member 86, first and second slide blocks 88 and 90, respectively, first and second slider bars 92 and 94, respectively, and first and second metallic channel members 96 and 98, respectively. The slider blocks 88 and 90 are fixed to the adjacent ends of the flexible guide portions 80 and 82, respectively, and the spring member 86 is linked to both of the slider blocks 88 and 90 via a plurality of nut and bolt combinations 100. The flexible guide members 80 and 82 have guide ears or flanges 102 and 104 disposed on opposite sides thereof which enter the C-shaped cross-sectional configuration of the handrail 9, with the guide flanges extending from the bight of a C-shaped portion which defines a channel for receiving the bolt head, or the nuts 106, of the nut and bolt combinations 100. The channel members have openings for receiving the bolts of the nut and bolt combinations 100, and they have a substantially C-shaped cross-sectional configuration which matches the C-shaped outer contour of the flexible members 80 and 82. The channel members 96 and 98 ensure that the C-shaped opening of the flexible guide members 80 and 82 maintain their shape, and they space the flexible guide members from the slider blocks 88 and 90 which are mounted on top of the channel members 96 and 98, respectively.

The slider blocks 88 and 90 are elongated members, with each having a pair of parallel, spaced openings therein disposed through the long portion of the blocks, with the longitudinal axes of the openings oriented parallel with the longitudinal axis of the flexible guide members. The two openings are sized and configured to smoothly accept the slider bars 92 and 94 with a slip-fit. The ends of the slider bars are threaded at opposite ends and nuts 108 disposed thereon. The slider blocks 88 and 90 also have a pair of openings whose axes are transverse to the axes of the first pair of openings, for receiving the nut and bolt combinations 100.

The leaf spring member 86 has first and second straight end portions 110 and 112, respectively, with each end portion having a pair of openings for receiving nut and bolt combinations 100. An intermediate portion 114 is smoothly bent into a U-shaped configuration, such that the spring member 86 biases the adjoining ends of the flexible guide members 80 and 82 away from one another. The nuts 108 on the ends of the slider bars 92 and 94 are adjusted until a predetermined gap 116 is achieved between the aligned ends of the flexible guide members 80 and 82. At this point, the handrail 8 is not yet disposed on the guide loop. The predetermined gap 116 may be approximately 1.5 inches, for example. The nuts 108 cooperate with the slider blocks to define the maximum desired gap.

Figure 5:
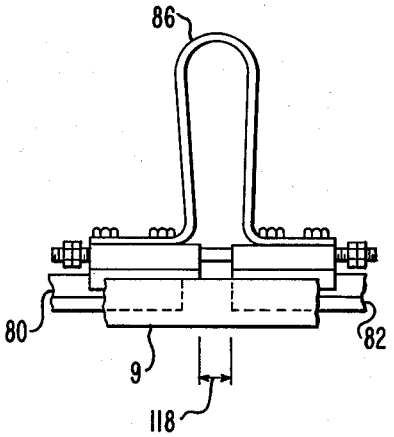
FIG. 5 illustrates the biasing means of FIG. 3 in the configuration after the handrail member has been installed on the guide loop, and the guide loop properly adjusted.

The handrail 9 is then installed on the guide member 11. The take-up **23*b* is then adjusted such that the gap 116 is reduced to a predetermined dimension 118, as shown in FIG. 5. As illustrated in FIG. 2, the take-up 23*b* may include first and second block members 120 and 122 fixed to the adjoining ends of the rigid and flexible guide members, respectively, interconnecting members 124, and a plurality of bolts 126. When the bolts 126 are loosened, the gap 11*h* may be changed to provide the desired gap 118 associated with the biasing means 84. If the gap 116 is 1.5 inches, gap 118 may be one inch, for example. This arrangement will place the handrail in slight tension, which will not adversely affect the push-pull driving of the handrail 9** about the guide loop. The length of the handrail loop can increase 0.5 inch, or decrease almost one inch, before forces between the guide member and handrail are sufficient to provide significant handrail wear. This automatic adjustment range can, of course, be increased by selecting the proper leaf spring.

Figure 6:
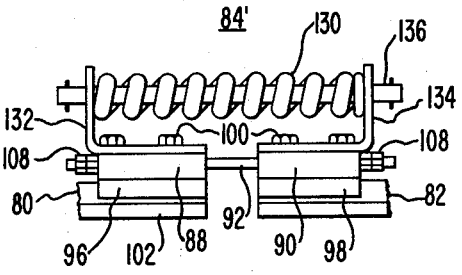
FIG. 6 illustrates an alternative embodiment of the biasing arrangement which may be used.

FIG. 6 is an elevational view of another embodiment of the biasing means, which is referenced 84' in order to indicate that the biasing means 84 of FIGS. 2, 3, 4 and 5 is modified in FIG. 6. Instead of using a leaf spring 86 as in the first embodiment, a long stroke spiral spring 130 is utilized. A pair of L-shaped spring seats 132 and 134 are mounted on top of the slider blocks 88 and 90, respectively. A guide rod 136 may be disposed through the spring opening, and also through aligned openings in the spring seats, if the spiral spring selected requires such stability and guidance.

In summary, there has been disclosed new and improved self-adjusting handrail apparatus which significantly improves the push-pull handrail drive arrangement of the incorporated patent, by reducing handrail wear, and by reducing the required frequency of guide loop adjustment. The substantial improvement may be accomplished quickly and for a very low cost, considering the reduction in field time and reduction in handrail wear which is achievable by utilizing the teachings of the invention.

I claim as my invention:

1. Continuously self-adjusting handrail apparatus for use on a handrail of a transportational apparatus wherein the handrail is available to be grasped by passengers, comprising:

guide means arranged in a guide loop having first and second aligned ends, a continuous handrail disposed on said guide means, first and second slide block members fixed to said first and second ends, respectively, of said guide loop, a slide bar member linking said first and second slide block members such that said first and second slide block members are slidable relative to said slide bar member, spring means disposed to urge said first and second slide block members apart, the loop lengths of said guide means and said handrail having a predetermined relationship wherein said spring means establishes a gap between said first and second slide block members, and maintains a tension in said handrail member, notwithstanding changes in the loop length of said handrail member over a predetermined range, and drive means coupled to said handrail member which pushes and pulls said handrail member about said guide loop.

2. The handrail apparatus of claim 1 including manually adjustable means for adjusting the loop length of the guide means to provide the predetermined relationship between the loop lengths of the guide means and the handrail member which enables the spring means to establish the desired gap between the first and second slide block members.

3. The handrail apparatus of claim 1 wherein the guide means includes flexible portions which start at the first and second ends of the guide loop and extend for a predetermined dimension therefrom.

4. The handrail apparatus of claim 1 wherein the spring means includes a leaf spring member arranged in a U-shaped configuration having first and second ends, and means fixing the first and second ends of the leaf spring member to the first and second said block members, respectively.

5. The handrail apparatus of claim 1 including first and second spring seat members fixed to the first and second slide block members, respectively, and wherein the spring means includes a coil spring member disposed to bias said spring members apart.

6. The handrail apparatus of claim 1 including adjustment means on the slide bar member for establishing the maximum possible gap between the first and second slide block members.

* * * * *